US005156290A

United States Patent [19]

Rodrigues

[11] Patent Number: 5,156,290

[45] Date of Patent: Oct. 20, 1992

[54] CONTAINER FOR RUBBISH

[76] Inventor: Vivian J. Rodrigues, 141 Grand Promenade, Bedford, 6052 Western Australia, Australia

[21] Appl. No.: 571,670

[22] PCT Filed: Nov. 7, 1989

[86] PCT No.: PCT/AU89/00477

§ 371 Date: Aug. 24, 1990

§ 102(e) Date: Aug. 24, 1990

[87] PCT Pub. No.: WO90/05098

PCT Pub. Date: May 17, 1990

[30] Foreign Application Priority Data

Nov. 8, 1988 [AU] Australia ..... PJ1353

[51] Int. Cl.[5] ..... B65D 25/00

[52] U.S. Cl. ..... 220/87.1; 220/367; 220/426; 220/908; 220/913

[58] Field of Search ..... 220/87.1, 908, 913, 220/426, 366, 367, 466, 468, 469, 371, 372, 745, 747

[56] References Cited

U.S. PATENT DOCUMENTS

| | | | |
|---|---|---|---|
| 1,058,205 | 4/1913 | Titus et al. | 220/87.1 |
| 1,157,008 | 10/1915 | Lang | 220/87.1 X |
| 1,158,958 | 11/1915 | Baumann et al. | 220/87.1 |
| 1,163,389 | 12/1915 | Brown | 220/87.1 X |
| 1,166,774 | 1/1916 | Mayer et al. | 220/87.1 |
| 1,231,553 | 6/1917 | Bach et al. | 220/87.1 |
| 1,331,428 | 2/1920 | Glud | 220/87.1 |
| 1,495,368 | 5/1924 | Witte et al. | 220/87.1 |
| 1,637,656 | 8/1927 | Radcliffe | 220/87.1 X |
| 1,656,015 | 1/1928 | Radcliffe | 220/87.1 |
| 1,678,839 | 7/1928 | Wilkins | 220/87.1 |
| 1,719,185 | 7/1929 | Lowy | 220/87.1 |
| 1,732,988 | 10/1929 | Ruhmann | 220/331 |
| 1,736,192 | 11/1929 | Easton | 220/401 |
| 1,836,297 | 12/1931 | Vienna | 220/87.1 |
| 1,886,630 | 11/1932 | Boundette | 220/87.1 |
| 1,928,864 | 10/1933 | Modad et al. | 220/87.1 |
| 2,067,547 | 1/1937 | Schneider et al. | 220/87.1 |
| 2,147,139 | 2/1939 | Bigman et al. | 220/87.1 |
| 2,216,807 | 10/1940 | Couch | 220/87.1 |
| 3,008,604 | 11/1961 | Garner | 220/87.1 |
| 3,342,368 | 9/1967 | Matry | 220/628 |

FOREIGN PATENT DOCUMENTS

| | | | |
|---|---|---|---|
| 0486275 | 11/1929 | Fed. Rep. of Germany | 220/87.1 |
| 0831786 | 2/1952 | Fed. Rep. of Germany | 220/87.1 |

*Primary Examiner*—Stephen Marcus
*Assistant Examiner*—Stephen Cronin
*Attorney, Agent, or Firm*—Ralph F. Crandell; Holland & Hart

[57] ABSTRACT

A container (11) for rubbish having an enclosed compartment (14) an inlet passageway formed within the walls (17) and (19) of the compartment (14), a closure (15) and an outlet passageway integrally formed within the inner and outer walls (41) and (43) of the closure (15). The inlet and outlet passageway insulate the interior of the compartment (14) by incorporating cavities (21) and (45) and are particularly arranged to produce convection current airflow whereby the inlet passageway directs ambient air from an entry port (31) externally of the compartment in an involuted manner through the walls of the compartment to a point marginally above the inner base of the compartment (14) and the outlet passageway extracts heated air from the top of the compartment interior through the entry port (47) of the closure and out through the annular exit port (49) thereof. Accordingly, ambient air is introduced to the container on a demand basis and heated air which promotes mouldering or composting is vented from the container to mitigate the same.

6 Claims, 2 Drawing Sheets

CONTAINER FOR RUBBISH

This invention relates to a container for rubbish particularly suited for both domestic and industrial use.

The common type of rubbish container for domestic rubbish disposal is of extremely simple and basic design to minimise manufacturing costs and hence retain cost in order to make the purchase of such containers attractive to the general public. Such types of containers have been found deficient for many reasons and in recent times there is a growing trend amongst City and Shire Councils alike to supply a modular mobile bin to facilitate rubbish collection. Such mobile bins are of a larger volume than the common types of rubbish containers and hence have found wide appeal amongst the general public since they are completely sealed from the exterior when the lid of the bin is closed, reducing problems such as fly infestation and reducing the level of malodour exuding from the bin. Unfortunately, however, this type of bin cannot handle wet garbage as the liquid in the bin is recycled. Thus, in the warmer months of the year, the bin is exposed to relatively high external temperatures causing the temperature of the contents of the bin to elevate, increasing the propensity of the rubbish to decompose and thus creating a malodorus and humid condition within the bin. Accordingly, when the lid of the bin is opened, the user of the bin may be presented with a highly obnoxious malodour which is much more concentrated than is generally the case with common types of rubbish containers and also can be blast by the malodorous air due to its elevated temperature and pressure within the bin. The user is thus left with the choice of carrying on using the bin as described above or trying to enclose the rubbish in plastic bags or the like creating environmental problems at the tip, (biodegradability of plastic is poor).

It is an object of the present invention to provide a container for rubbish which overcomes substantially all of the aforementioned problems associated with common types of rubbish containers and mobile bins for the collection and removal of rubbish.

In accordance with one aspect of the present invention there is provided a container for rubbish comprising:

- a compartment having an opening to enable rubbish to be deposited and discharged therethrough;
- an inlet for introducing air from the outside of said container into the lower confines of said compartment;
- an outlet for venting air from the upper confines of said compartment to the outside of said container; and
- a closure for closing said opening.

Preferably, said outlet is integrally formed with said closure and said inlet is integrally formed with said compartment.

Preferably, said inlet comprises an inlet passageway defined by a cavity interposed between inner and outer walls of said compartment, said inlet passageway having an entry port provided in said outer wall to allow the ingress of air into said cavity and an outlet port disposed circumferentially around the interior of said compartment proximate to the base of said compartment to allow the egress of air into said compartment, whereby said inner and outer walls and said cavity insulate said compartment.

Preferably said inlet passageway is involuted, whereby said entry port is disposed towards the bottom of said compartment and said inlet passageway extends initially circumferentially from said entry port upwardly towards the top of said compartment to be defined by an outer cavity and subsequently involutes to extend circumferentially from said top towards the base of said compartment to be defined by an inner cavity, whereby said inner and outer walls and said inner and outer cavities doubly insulate said compartment.

Preferably said outlet comprises an outlet passageway defined by a cavity interposed between inner and outer walls of said closure, said outlet passageway having an entry port provided in said inner wall to allow the ingress of air from said compartment into said cavity, and an outlet port disposed circumferentially around the exterior of said closure and being cowled to allow the egress of air from said outlet passageway, whereby said inner and outer walls of said closure insulate the top of said compartment.

The invention will be better understood in the light of the following description of two specific embodiments thereof. The description of the embodiments is made with reference to the accompanying drawings, wherein.

Figure 2:
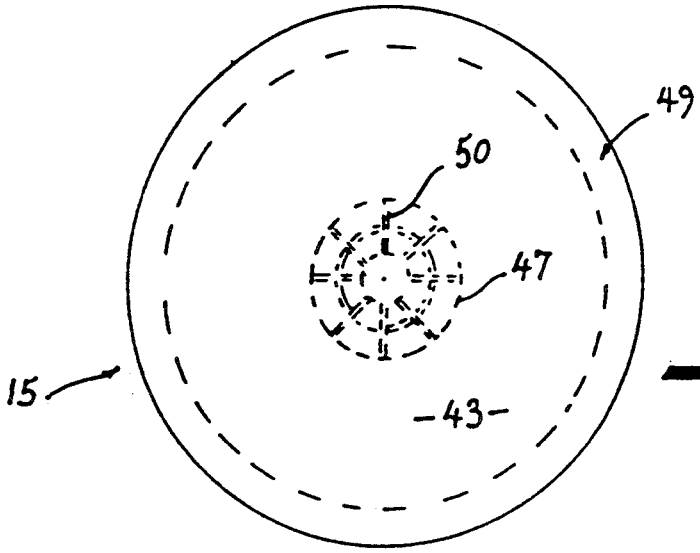
FIG. 2 is a top view of the closure shown at FIG. 1.
Figure 1:
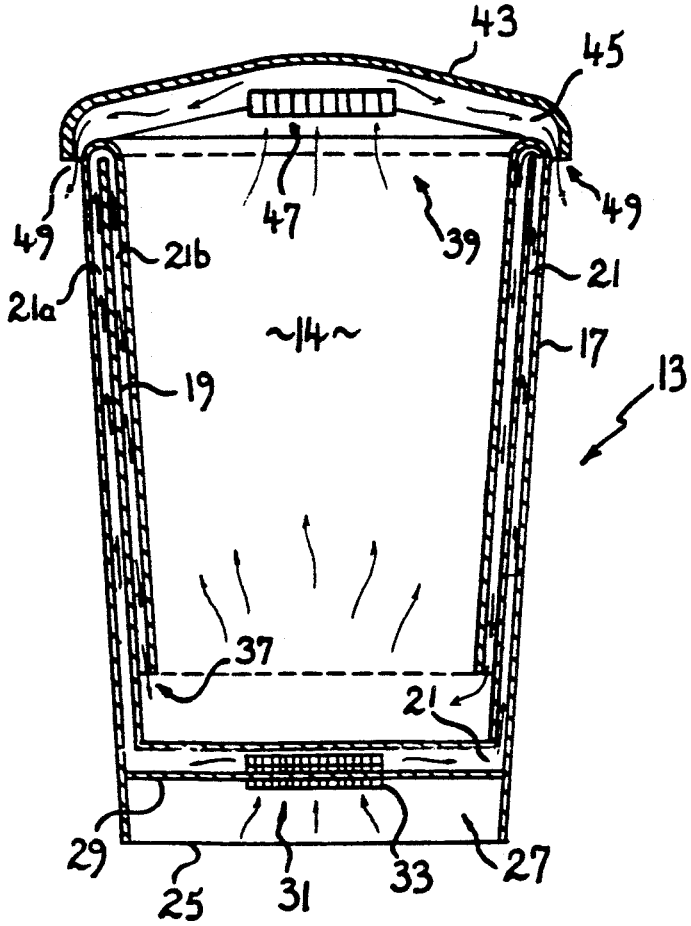
FIG. 1 is a sectional longitudinal elevation of the container in accordance with the first embodiment showing the direction in which air is passed through the container.

The first embodiment is directed towards a container 11 for rubbish as shown at FIGS. 1 and 2 of the accompanying drawings, generally comprising a receptacle 13 and a closure 15.

The receptacle comprises a compartment 14 having an outer wall 17 which is generally cylindrical in shape and being flared from the bottom of the receptacle towards the top of the receptacle and an inner wall 19 of similar shape to the outer wall but of a marginally lesser diameter to define a cavity 21 between the inner and outer walls. The top of the receptacle 13 defines a circular opening 39 to enable rubbish to be deposited and discharged therethrough into the confines of the receptacle. The inner wall 19 is terminated inwardly of the receptacle 13 by a base 23 which is spaced above the bottom of the receptacle defined by the lower extremity or skirt 25 of the outer wall 17 and which extends radially in a horizontal plane when the container is disposed in the upright position as shown at FIG. 1 of the drawings. Consequently, the inner wall 19 and the base 23 combine to form the compartment 14. An outer base 29 is spaced axially from the inner base 23 towards the lower extremity of the outer wall 25 to extend the cavity 21 in a radial direction of the receptacle directly below the inner base 23 and furthermore provide an entry port 31 in the region below the base for air to ingress into the cavity 21.

The entry port 31 comprises an aperture disposed centrally within the lower base 29 which is exteriorly covered by a removable fly wire mesh 33 to prevent the entry of flies or the like into the cavity 21, and a recess 35 provided within the cavity directly opposite the aperture to house a deodorant block or the like for dispensation of clean odour into the airflow passing along the cavity 21.

The cavity 21 extends upwardly from the entry port 31 circumferentially of the receptacle to the top of the receptacle and involutes to be subsequently directed from the top of the receptacle downwardly towards the base 23 of the receptacle along the inner wall 19. The cavity 21 is terminated marginally above the base 23 to define an annular exit port 37 from which air may egress into the lower confines of the receptacle. Consequently the inner and outer walls 19 and 17 and the cavity 21 form an inlet comprising an inlet passageway extending from the entry port 31 to the exit port 37. Furthermore, the provision of an outer cavity 21*a* and an inner cavity 21*b* doubly insulate the compartment 14 from the external environment.

The closure 15 is in the form of a circular lid also having inner and outer walls 41 and 43 respectively. The inner wall 41 extends radially in substantially parallel relation with the outer wall 43 to provide a cavity 45 therebetween. The inner wall extends radially a distance commensurate to the diameter of the opening 39 and is concavely curved at its outermost extremities to enable the closure to seat in juxtaposed and sealing relationship with the top of the receptacle in the manner shown at FIG. 1 of the drawings. A central aperture is formed within the inner wall 41 to define an entry port 47 for the outlet passageway defined by the cavity 45. The aperture is covered by a radial grille 50 in the manner shown at FIG. 2 of the drawings to allow the ingress of air from the upper regions of the compartment into the cavity 45. The inner and outer walls 41 and 43 of the closure and the cavity form an outlet comprising an outlet passageway extending radially outwardly from the entry port 47 to terminate at an annular exit port 49 disposed around the outer circumference of the walls 41 and 43. The outer wall 43 is cowled downwardly around the outer circumference thereof to protect the outlet port 49 from the weather and also to discourage the entry of flies or the like.

In operation, rubbish may simply be deposited into the receptacle through the opening 39 by opening the closure 15 and upon sealing the receptacle, air will be allowed to ingress through the inlet passageway via the entry port 31 and flow along the outer cavity 21*a* the inner cavity 21*b* and into the lower confines of the compartment. This relatively fresh air is allowed to permeate the rubbish thereby ventilating the same to maintain the temperature of the compartment and remove moisture therefrom. The air ultimately upon increasing in temperature rises through the interior of the compartment to ingress through the entry port 47 of the closure and enter the outlet passageway. This air flows along the cavity 45 to egress through the outlet port 49 of the closure and so be vented to the external environment. Effectively a convection current of air flow is provided which mitigates the elevation of temperatures within the compartment and the propensity of the rubbish towards decomposing. Consequently, the build up of malodours and high pressures within the container is appreciably mitigated avoiding the problems associated with previous types of rubbish containers and bins used for the collection and removal of rubbish.

It should be noted that the particular arrangement of the conformer creates an effect where decomposing or mouldering of the rubbish is opposed since it is principally the effects of decomposing or mouldering which creates the malodour, increased temperature and high pressures within a closed environment housing rubbish.

It should be appreciated that the provision of the inner and outer cavities 21*a* and 21*b* of the compartment and the cavity 45 of the closure all combine to assist in insulating the compartment from the temperatures of the external environment and consequently play an important role in maintaining reduced temperatures in the compartment.

Figure 4:
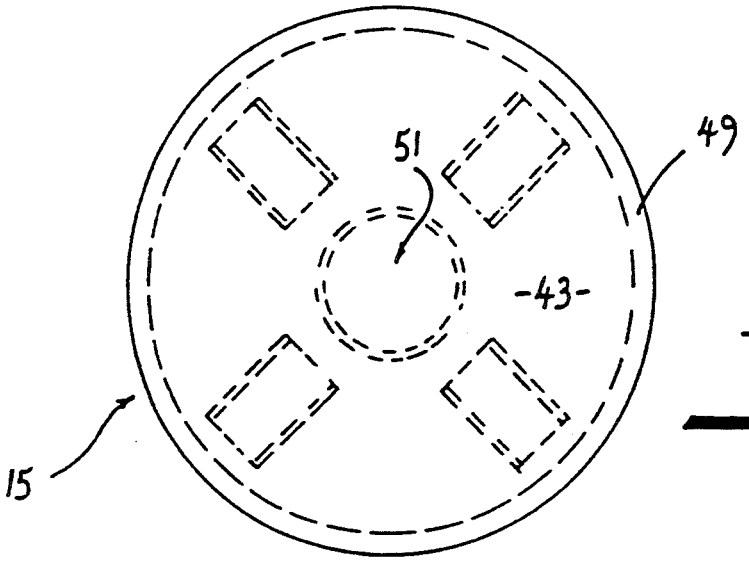
FIG. 4 is a top view of the closure of FIG. 3.
Figure 3:
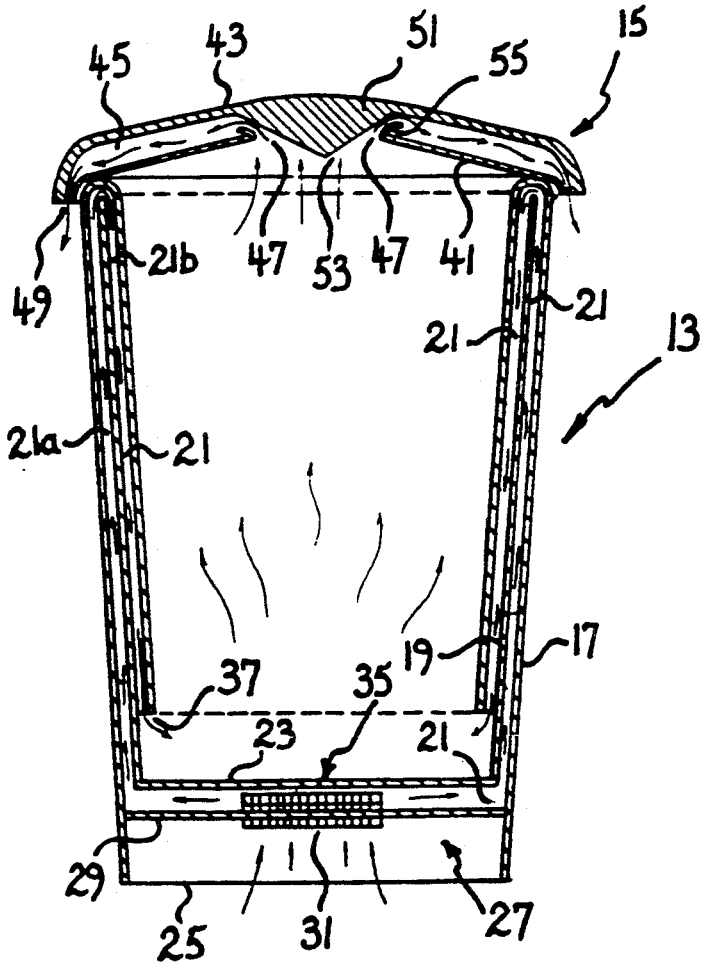
FIG. 3 is a longitudinal sectional view of the container in accordance with the second embodiment.

The second embodiment is substantially identical to the preceding embodiment except that the entry port for the closure is of an alternative design as shown at FIGS. 3 and 4 of the drawings.

Moreover, the closure 15 has the outer wall 43 provided with a central deflector 51 which extends axially through the cavity 45 to project inwardly of the compartment through the aperture provided in the inner wall 41 of the closure. The deflector 51 is essentially cone shaped to direct air through the aperture 53 of the inner wall 41 into the cavity 45 to be directed radially in opposite directions out through the exit port 49 of the closure. The periphery of the aperture 53 is provided with a circumferential lip 55 which projects back into the cavity and which is disposed in closely spaced relation with the surface of the deflector 51 to restrict access into the compartment 14 thereby preventing flies from depositing eggs into the bin, a problem which may arise in the adoption of the design of the previous embodiment.

It should be appreciated that the scope of the present invention is not limited to the particular embodiments herein described where alternative designs of container may be provided without departing from the spirit of the invention.

I claim:

1. In a closed, vented rubbish container including a receptacle for receiving and containing the rubbish and a cover for closing the receptacle, said receptacle comprising an inner container having a side wall integrally joined to a base wall and adapted to receive and contain rubbish, an outer container enclosing said inner container in spaced relation therewith, said outer container having an outer wall and a base joined to said outer wall adjacent to the lower end thereof, said outer wall being involuted in configuration so as to extend upwardly from said base of the outer container and turn inwardly and downwardly at the upper end of the outer wall and subsequently terminate near said base of the inner container in spaced relationship therewith, said outer wall thereby defining a cavity therein for receiving said inner container side wall and defining therewith an air passage, the inner lower portion of said outer side wall cooperating with said base of the inner container in defining an air outlet port, entry means defining an air intake port in said outer container in communication with said air passage for supplying ventilated air through said air passage to the interior of said inner container whereby rubbish contained in the receptacle is ventilated.

2. A rubbish container as defined in claim 1 wherein said cover comprises an outer wall, an inner wall secured to said outer wall in spaced relation thereto and defining therewith a second air passage, means adjacent the outer peripheral edge of said outer wall of the cover defining an air exit port from said second air passage, and means defining an air inlet port in said cover centrally of said inner wall of the cover and opening into said second air passage whereby when said cover is positioned on said receptacle, air exhausted from said receptacle flows through said cover inlet port said second air passage, and exit port.

3. A rubbish container as defined in claim 2 further comprising a screen mounted in said air inlet port.

4. A rubbish container as claimed in claim 1, further comprising a screen mounted in said air intake port.

5. A rubbish container as defined in claim 4, wherein said screen supports a deodorant material.

6. A rubbish container as defined in claim 1 further comprising a supporting skirt integral with and depending from said outer wall of said outer container adjacent to the base thereof.

* * * * *